US010829985B2

(12) United States Patent
Jejina

(10) Patent No.: US 10,829,985 B2
(45) Date of Patent: Nov. 10, 2020

(54) INSULATED ATTIC HATCH

(71) Applicant: Mark Jejina, Innisfail (CA)

(72) Inventor: Mark Jejina, Innisfail (CA)

( * ) Notice: Subject to any disclaimer, the term of this patent is extended or adjusted under 35 U.S.C. 154(b) by 0 days.

(21) Appl. No.: 15/625,140

(22) Filed: Jun. 16, 2017

(65) Prior Publication Data

US 2017/0362885 A1 Dec. 21, 2017

Related U.S. Application Data

(60) Provisional application No. 62/350,806, filed on Jun. 16, 2016.

(51) Int. Cl.

| | |
|---|---|
| ***E06B 5/01*** | (2006.01) |
| ***E06B 11/02*** | (2006.01) |
| ***E06B 5/04*** | (2006.01) |
| *E04B 7/00* | (2006.01) |
| *E04H 9/00* | (2006.01) |

(52) U.S. Cl.

CPC ..... *E06B 5/01* (2013.01); *E06B 5/04* (2013.01); *E06B 11/02* (2013.01); *E04B 7/00* (2013.01); *E04H 9/00* (2013.01)

(58) Field of Classification Search

CPC .... E06B 5/01; E06B 11/02; E06B 2003/7063; E04B 9/003; E04B 1/7604; E04B 1/78; E04B 9/001

See application file for complete search history.

(56) References Cited

U.S. PATENT DOCUMENTS

| | | | | | |
|---|---|---|---|---|---|
| 2,793,688 | A * | 5/1957 | Robey | E06B 9/52 | 160/104 |
| 3,965,594 | A * | 6/1976 | Candor | A47G 1/06 | 40/533 |
| 4,299,059 | A * | 11/1981 | Smith | E06B 5/16 | 182/47 |
| 4,563,845 | A * | 1/1986 | Stipe | E06B 5/01 | 52/202 |
| 4,761,920 | A * | 8/1988 | Coulson | E06B 3/9641 | 52/19 |
| 4,903,455 | A * | 2/1990 | Veazey | E04B 1/0046 | 52/73 |
| 5,628,151 | A * | 5/1997 | Monat | E04F 11/062 | 182/46 |
| 6,578,327 | B1 * | 6/2003 | Hackbarth | E06B 5/01 | 182/129 |
| 6,701,676 | B1 * | 3/2004 | Kompelien | E04B 9/003 | 52/186 |

(Continued)

*Primary Examiner* — Brian E Glessner
*Assistant Examiner* — Daniel J Kenny
(74) *Attorney, Agent, or Firm* — Bennett Jones LLP

(57) ABSTRACT

An attic access assembly includes an outer frame and a panel subassembly. The outer frame attaches to a ceiling and frames an attic opening. The panel subassembly includes a central panel that fits within the outer frame, and a flexible barrier that defines an insulation pocket extending upwardly from the central panel. The central panel may include an insulating foam material. The insulation pocket is used to contain an insulating material. Weatherstripping seals the panel subassembly to the outer frame. The panel subassembly may include a panel frame that fits within the outer frame, frames the central panel, and defines a groove to retain a weatherstripping seal.

18 Claims, 1 Drawing Sheet

(56) References Cited

U.S. PATENT DOCUMENTS

| | | | | |
|---|---|---|---|---|
| 7,089,704 | B2 * | 8/2006 | Jejina | E06B 5/01 52/19 |
| 7,770,353 | B2 * | 8/2010 | Olsen | E04B 1/80 52/19 |
| 8,661,750 | B2 * | 3/2014 | Melesky | E04B 1/7608 52/199 |
| 9,222,265 | B2 * | 12/2015 | Richmond | E04F 11/062 |
| 9,249,614 | B1 * | 2/2016 | Mucciolo | E06B 5/01 |
| 9,783,981 | B2 * | 10/2017 | Rinne | E04B 1/767 |
| 9,822,526 | B2 * | 11/2017 | Cook | E04B 1/7604 |
| 2009/0133342 | A1 * | 5/2009 | Copeland | E04B 9/003 52/202 |
| 2009/0277099 | A1 * | 11/2009 | Ogieglo | E06B 5/01 52/19 |
| 2011/0265392 | A1 * | 11/2011 | Uhl | E04B 9/003 52/20 |
| 2012/0328807 | A1 * | 12/2012 | Grimes | E06B 5/01 428/35.5 |

* cited by examiner

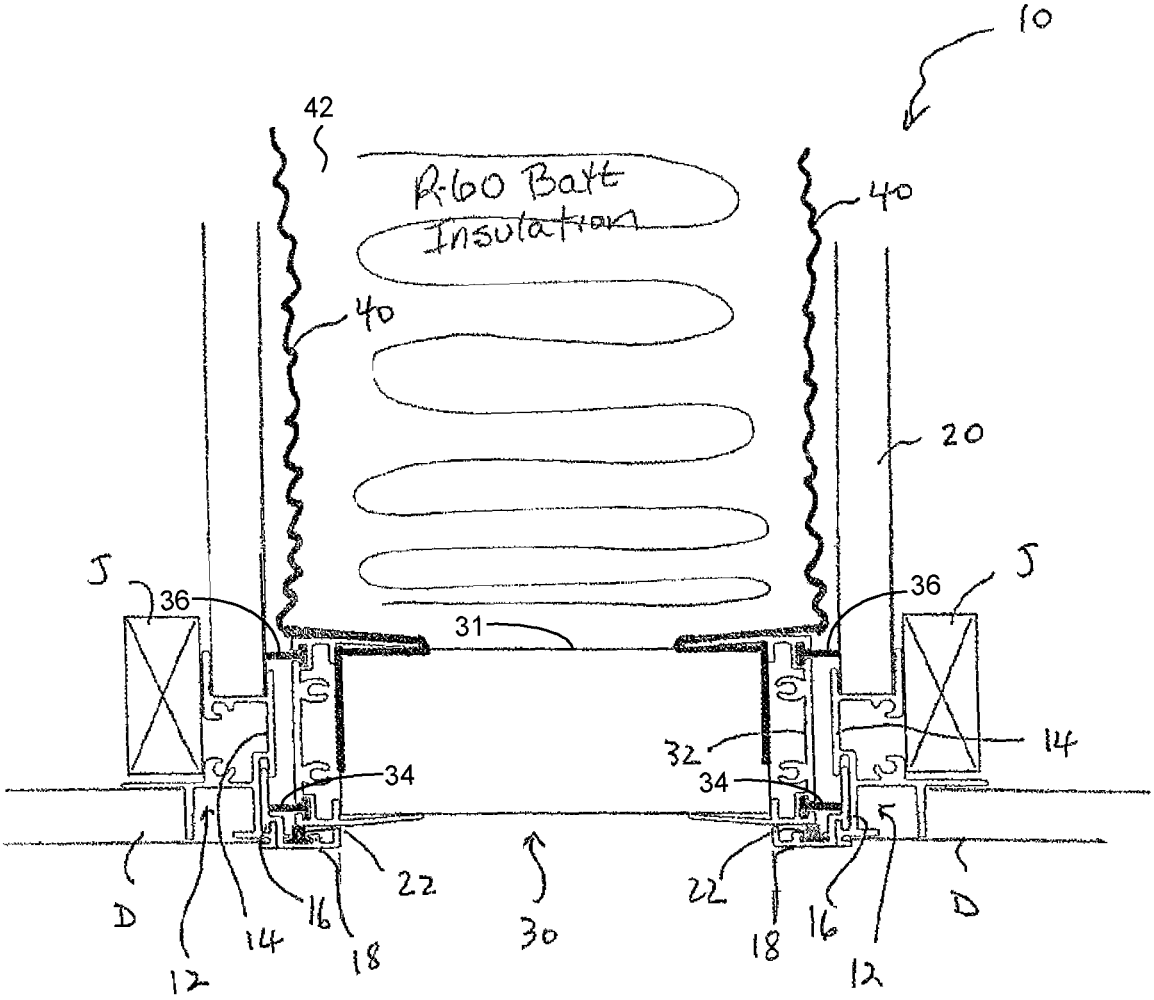
10
42
R-60 Batt Insulation
40
40
20
J
36
36
J
31
32
14
34
34
22
22
D
D
12
14
16
18
30
18
16
12

INSULATED ATTIC HATCH

FIELD OF THE INVENTION

The present invention relates to a sealed and insulated attic access door, and to a method of finishing an attic opening.

BACKGROUND

Building codes typically require attic access that meets certain size, sealing and thermal resistance requirements. Typical attic access doors are poorly insulated and sealed. There is a need in the art for better or alternative solutions.

SUMMARY OF THE INVENTION

In one aspect, the present invention comprises an attic access assembly. The attic access assembly includes an outer frame and a panel subassembly. The outer frame is adapted to attach to a ceiling, and frame an attic opening. The panel subassembly includes a central panel adapted to fit within the outer frame, and a flexible barrier defining an insulation pocket extending upwardly from the central panel.

In embodiments of the attic access assembly, the outer frame defines a groove adapted to receive an insulation dam.

In embodiments of the attic access assembly, the central panel includes an insulating foam material.

In embodiments of the attic access assembly, the flexible barrier includes plastic sheeting, which may include polyethylene sheeting.

In embodiments of the attic access assembly, the attic access assembly further includes at least one weather stripping seal for sealing at least part of the panel subassembly to the outer frame. The at least one weather stripping seal may be retained in a groove formed in the outer frame or the panel subassembly.

In embodiments of the attic access assembly, the panel subassembly further includes a panel frame framing the central panel and adapted to fit within the outer frame. The panel subassembly may further include at least one weatherstripping seal that seals the panel frame to the outer frame. The at least one weatherstripping seal may be retained in a groove formed in the panel frame. An end of the flexible barrier may be inserted between the panel frame and the central panel.

In another aspect, the present invention comprises a panel subassembly for use in an attic access assembly comprising an outer frame framing an attic opening. Embodiments of the panel subassembly and its constituent central panel, flexible barrier, and (where present) panel frame and at least one weather stripping seal, are summarized above.

In another aspect, the present invention includes a method of finishing an attic opening. The method includes the steps of: (a) attaching an outer frame to a ceiling to frame the attic opening; and (b) installing a panel subassembly comprising: a central panel adapted to fit within the outer frame; and a flexible barrier defining an insulation pocket extending upwardly from the central panel.

In embodiments of the method, the panel subassembly further includes at least one weatherstripping seal that seals the panel subassembly to the outer frame.

In embodiments of the method, the method further includes the step of filling the insulation pocket with an insulating material.

BRIEF DESCRIPTION OF THE DRAWINGS

The following drawings form part of the specification and are included to further demonstrate certain embodiments or various aspects of the invention. In some instances, embodiments of the invention can be best understood by referring to the accompanying drawings in combination with the detailed description presented herein. The description and accompanying drawings may highlight a certain specific example, or a certain aspect of the invention. However, one skilled in the art will understand that portions of the example or aspect may be used in combination with other examples or aspects of the invention.

FIG. 1 is a cross-sectional view of one embodiment of the invention assembled and installed in a ceiling.

DETAILED DESCRIPTION

The invention relates to an attic access assembly (10), one embodiment of which is shown in FIG. 1.

Conventional wood frame construction comprises roof trusses having joists (J) which run longitudinally between vertical walls to form the ceiling. Drywall (D) or other interior finishes are attached to the underside of the roof joists (J). The drywall (D) or other interior finishes and the joists (J) collectively define an attic opening.

In one embodiment, the attic access assembly (10) comprises an outer frame (12) which is installed to frame the attic opening. In an exemplary embodiment, the outer frame (12) may comprise an extruded plastic or metal piece having a profile which allows insertion of the frame between the drywall (D) or other interior finish and a roof joist (J). An upper portion (14) of the profile of the outer frame (12) may abut the joist (J) and form a groove which is adapted to receive and retain a vertically extending insulation dam (20). The insulation dam (20) is conventionally a thin sheet (e.g., ⅜ inch) of plywood or oriented strand board (OSB), and functions to retain insulating material which is placed between and over top of the joists (J) away from the attic opening, as is well known in the art. A lower portion of the profile of the outer frame (12), or a separate extruded piece (16) which interlocks with the main extrusion of the outer frame (12), may comprise a retaining shoulder (18). Preferably, a perimeter weatherstripping seal (22) sits on the retaining shoulder (18), facing upwards. In the exemplary embodiment, the weatherstripping seal (22) has a T-shaped cross-section, the head of which is received within a complementary shaped groove defined by the retaining shoulder (18) to retain the weatherstripping seal (22). In exemplary embodiments, the weatherstripping seal (22) may comprise conventional plastic or elastomer trim, or pile (mohair) attached to a metal or plastic fin.

A panel subassembly (30) includes a central panel (31), which is preferably a rigid insulated panel, that is framed with a panel frame (32), which is adapted to install within the outer frame (12) and rest on the retaining shoulder (18) against the perimeter weatherstripping seal (22). Lower weatherstripping seal (34) and upper weatherstripping seal (36), (which in exemplary embodiments, may comprise conventional plastic or elastomer trim, or pile (mohair) attached to a metal or plastic fin), are installed around the panel frame (32) to seal the outside of the panel frame (32) against the inside of the outer frame (12) and the insulating dam (20), respectively. In the exemplary embodiment, the weatherstripping seals (34, 36) have a T-shaped cross-section, the head of which are received within complementary shaped grooves defined by the panel frame (32) to securely retain the weatherstripping seals (34, 36).

The panel subassembly (30) features an insulation pocket (42) that extends upwardly from the central panel (31). The insulation pocket (42) is formed by a flexible barrier (40), which is preferably formed from plastic sheeting used as a vapour barrier in residential construction. For example, 6 mil polyethylene sheeting is particularly suitable. The flexible barrier (40) may be attached to the central panel (31) or panel frame (32) in any suitable manner. It is convenient to insert one end of the flexible barrier (40) between the central panel (31) and the panel frame (32).

The insulation pocket (42) may be filled with an insulating material, such as fiberglass batt insulation. The insulation pocket (42) is sized such that the flexible barrier (40), when filled with insulation, will abut against the insulation dam (20) around the entire perimeter of the insulation pocket (42), thereby creating an effective insulating barrier. The insulation pocket (42) has a top opening having a horizontal width at least coextensive with a horizontal width of the central panel (31).

In one embodiment, the central panel (31) comprises steel or fiberglass door material which comprises rigid panels sandwiching an insulating material such as expanded polystyrene foam, as described in U.S. Pat. No. 7,089,704, the entire contents of which are incorporated herein by reference, where permitted. Such material typically has an insulating value of about R12. A fiberglass batt having insulation value of about R60 (approximately 12" or 30 cm thick) can be placed in the insulating pocket (42), giving the attic access assembly a combined R72 rating. As well, the perimeter of the opening is well sealed with the weatherstripping seals (22, 34, 36).

Definitions and Interpretation

The description of the present invention has been presented for purposes of illustration and description, but it is not intended to be exhaustive or limited to the invention in the form disclosed. Many modifications and variations will be apparent to those of ordinary skill in the art without departing from the scope and spirit of the invention. Embodiments were chosen and described in order to best explain the principles of the invention and the practical application, and to enable others of ordinary skill in the art to understand the invention for various embodiments with various modifications as are suited to the particular use contemplated.

References in the specification to "one embodiment", "an embodiment", etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such aspect, feature, structure, or characteristic with other embodiments, whether or not explicitly described. In other words, any element or feature may be combined with any other element or feature in different embodiments, unless there is an obvious or inherent incompatibility between the two, or it is specifically excluded.

It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The singular forms "a," "an," and "the" include the plural reference unless the context clearly dictates otherwise. The term "and/or" means any one of the items, any combination of the items, or all of the items with which this term is associated. The phrase "one or more" is readily understood by one of skill in the art, particularly when read in context of its usage.

As will also be understood by one skilled in the art, all language such as "up to", "at least", "greater than", "less than", "more than", "or more", and the like, include the number recited and such terms refer to ranges that can be subsequently broken down into sub-ranges as discussed above. In the same manner, all ratios recited herein also include all sub-ratios falling within the broader ratio.

The term "about" can refer to a variation of ±5%, ±10%, ±20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

What is claimed is:

1. An attic access assembly comprising:

an outer frame adapted to attach to a ceiling and frame an attic opening; and a panel subassembly comprising:

a central panel adapted to fit within the outer frame;

a flexible barrier defining an insulation pocket extending upwardly from the central panel, wherein the insulation pocket has a top opening having a horizontal width at least coextensive with a horizontal width of the central panel, and wherein the flexible barrier comprises plastic sheeting; and a panel frame framing the central panel and adapted to fit within the outer frame, wherein an end of the flexible barrier is inserted between the panel frame and the central panel, whereby the flexible barrier is attached to the central panel.

2. The assembly of claim 1, wherein the outer frame defines a groove adapted to receive an insulation dam around a perimeter of the insulation pocket, and wherein the insulation pocket is sized such that the flexible barrier abuts against the insulation dam when the insulation pocket is filled with insulation.

3. The assembly of claim 1, wherein the central panel comprises an insulating foam material.

4. The assembly of claim 1, wherein the plastic sheeting comprises polyethylene sheeting.

5. The assembly of claim 1, further comprising at least one weather stripping seal for sealing at least part of the panel subassembly to the outer frame.

6. The assembly of claim 1, wherein the panel subassembly further comprises: a panel frame framing the central panel and adapted to fit within the outer frame; and at least one weatherstripping seal that seals the panel frame to the outer frame.

7. The assembly of claim 6, wherein the at least one weatherstripping seal is retained in a groove formed in the panel frame.

8. A panel subassembly for use in an attic access assembly comprising an outer frame framing an attic opening, the panel subassembly comprising:

a central panel adapted to fit within the outer frame;

a flexible barrier defining an insulation pocket extending upwardly from the central panel, wherein the insulation pocket has a top opening having a horizontal width at least coextensive with a horizontal width of the central panel, and wherein the flexible barrier comprises plastic sheeting; and a panel frame framing the central panel and adapted to fit within the outer frame, wherein an end of the flexible barrier is inserted between the panel frame and the central panel, whereby the flexible barrier is attached to the central panel.

9. The subassembly of claim 8, wherein the central panel comprises an insulating foam material.

10. The subassembly of claim 8, further comprising at least one weatherstripping seal for sealing at least part of the panel subassembly to the outer frame.

11. The subassembly of claim 8, further comprising a panel frame framing the central panel and adapted to fit within the outer frame, and at least one weatherstripping seal for sealing the panel frame to the outer frame.

12. The subassembly of claim 11, wherein the at least one weatherstripping seal is retained in a groove formed in the panel frame.

13. The subassembly of claim 8, wherein the plastic sheeting comprises polyethylene sheeting.

14. The subassembly of claim 8, wherein the outer frame defines a groove adapted to receive an insulation dam around a perimeter of the insulation pocket, and wherein the insulation pocket is sized such that the flexible barrier abuts against the insulation dam when the insulation pocket is filled with insulation.

15. A method of finishing an attic opening, the method comprising the steps of:

(a) attaching an outer frame to a ceiling to frame the attic opening; and (b) installing a panel subassembly comprising:

a central panel adapted to fit within the outer frame;

a flexible barrier defining an insulation pocket extending upwardly from the central panel, wherein the insulation pocket has a top opening having a horizontal width at least coextensive with a horizontal width of the central panel, and wherein the flexible barrier comprises plastic sheeting; and a panel frame framing the central panel and adapted to fit within the outer frame, wherein an end of the flexible barrier is inserted between the panel frame and the central panel, whereby the flexible barrier is attached to the central panel.

16. The method of claim 15, wherein the panel subassembly further comprises at least one weatherstripping seal that seals the panel subassembly to the outer frame.

17. The method of claim 15, further comprising the step of filling the insulation pocket with an insulating material.

18. The method of claim 15, wherein the outer frame defines a groove adapted to receive an insulation dam around a perimeter of the insulation pocket, and wherein the insulation pocket is sized such that the flexible barrier abuts against the insulation dam when the insulation pocket is filled with insulation.

* * * * *